US006020548A

United States Patent [19]

Kurosaki

[11] Patent Number: 6,020,548

[45] Date of Patent: Feb. 1, 2000

[54] STAND FOR MUSICAL INSTRUMENT LESS OBSTRUCTIVE TO PLAYER

[75] Inventor: Makoto Kurosaki, Shizuoka, Japan

[73] Assignee: Yamaha Corporation, Japan

[21] Appl. No.: 09/158,044

[22] Filed: Sep. 22, 1998

[30] Foreign Application Priority Data

Sep. 22, 1997 [JP] Japan ..... 9-256515

[51] Int. Cl.[7] ..... G10D 13/02

[52] U.S. Cl. ..... 84/421; 84/422.3

[58] Field of Search ..... 84/421, 422.1, 84/422.2, 422.3

[56] References Cited

U.S. PATENT DOCUMENTS 3,167,995 2/1965 Londe ..... 84/421
5,105,706 4/1992 Lombardi .

FOREIGN PATENT DOCUMENTS 52-134324 10/1977 Japan .
52-134325 10/1977 Japan .
54-111141 8/1979 Japan .

*Primary Examiner*—Robert E. Nappi
*Assistant Examiner*—Shih-yung Hsieh
*Attorney, Agent, or Firm*—Ostrolenk, Faber, Gerb & Soffen, LLP

[57] ABSTRACT

A high hat stand keeps high hat cymbals over a floor, a foot pedal is connected to a rod slidable inserted in a guide for clashing the high hat cymbals, and a biped supporter is connected to the guide so as to keep the guide upright to the floor in cooperation with the foot pedal, wherein the two legs and the foot pedal are arranged in such a manner as to form a virtual triangle on the floor, and an additional leg is detachable from the guide so as to change the biped supporter to a tripod.

15 Claims, 4 Drawing Sheets

STAND FOR MUSICAL INSTRUMENT LESS OBSTRUCTIVE TO PLAYER

FIELD OF THE INVENTION

This invention relates to a stand for a musical instrument and, more particularly, to a stand for a musical instrument such as, for example, high hat cymbals.

DESCRIPTION OF THE RELATED ART

High hat cymbals are mounted in face-to-face relation on a stand, which is called "high hat stand", and a player steps on a pedal so as to clash the high hat cymbals. Thus, the high hat stand not only supports the high hat cymbals but also moves one high hat cymbals to the other.

A typical example of the high hat stand is illustrated in FIG. 1 of the drawings. The prior art high hat stand is broken down into a mechanical actuator 1 and a tripod 2. The mechanical actuator 1 keeps one 3*a* of the high hat cymbals 3*a*/3*b* stationary and the other 3*b* movable. While no force is exerted on the mechanical actuator 1, the high hat cymbal 3*b* is spaced from the other high hat cymbal 3*a*. When force is exerted, the high hat cymbal 3*b* is clashed with the other high hat cymbal 3*a*, and, thereafter, returns to the initial position. On the other hand, the tripod 2 keeps the mechanical actuator 1 upright with respect to a floor. A player sits on a chair in front of the prior art high hat stand, and exerts the force on the mechanical actuator 1. The tripod 2 is foldable, and the player folds the tripod 2 for custody.

The mechanical actuator 1 largely comprises a guide 1*a*, a rod 1*b*, a foot pedal 1*c* and a spring unit 1*d*. Tube members 1*e*/1*f* and a clamper 1*g* form the guide 1*a*. The tube members 1*e*/1*f* are different in diameter, and the tube member 1*e* is slidable into the other tube member 1*f*. The clamper 1*e* is attached to the upper end of the tube member 1*f*, and clamps and releases the other tube member 1*e*. Thus, the guide 1*a* is expandable and contractible.

The rod 1*b* is inserted into the tube members 1*e*/1*f*, and the upper end portion of the rod 1*b* projects from the upper end of the tube member 1*e*. The stationary high hat cymbal 3*a* is fixed to the upper end of the tube member 1*e* by means of a coupling 1*h*, and the other high hat cymbal 3*b* is connected to the upper end portion of the rod 1*b* by means of a coupling 1*j*. The high hat cymbal 3*b* is moved together with the rod 1*b*, and is clashed with the stationary high hat cymbal 3*a*.

The foot pedal 1*c* includes a pedal frame 1*k*, a pedal plate 1*m* and a transmission member 1*n*. The pedal frame 1*k* has an L-letter configuration, and is placed on the floor. The vertical portion of the pedal frame 1*k* is connected to the tube member 1*f*, and keeps the guide 1*a* and the high hat cymbals 3*a*/3*b* upright in cooperation with the tripod 2. The pedal frame 1*k* has a heel 1*p*, and the heel 1*p* slopes. The pedal plate 1*m* is connected at one end thereof to the heel 1*p*, and the heel 1*p* provides a axis of rotation for the pedal plate 1*m*. The transmission member 1*n* is implemented by a belt, and is connected between the other end of the pedal member 1*m* and the lower end of the rod 1*b*. The belt is flexible, and, for this reason, the transmission member 1*n* converts the turning motion of the pedal plate 1*m* to the straight motion of the rod member 1*b*. The spring unit 1*d* is attached to the tube member 1*f*, and has a return spring (not shown) connected to the lower end of the rod 1*b*. The return spring upwardly urges the rod 1*b* at all times, and causes the rod 1*b* to space the high hat cymbal 3*b* from the stationary high hat cymbal 3*a*. The return spring causes the pedal plate 1*m* to turn in the clockwise direction, and the pedal plate 1*m* is continued to the slope of the heel 1*p*. Thus, the pedal plate 1*m* is turnable in the counter clockwise direction.

When the player steps on the pedal plate 1*m*, the pedal plate 1*m* turns in the counter clockwise direction, and pulls down the transmission member 1*n*. The transmission member 1*n* in turn pulls down the rod 1*b*, and the high hat cymbal 3*b* is clashed with the stationary high hat cymbal 3*a*. When the player releases the pedal plate 1*m*, the return spring urges the rod 1*b* upwardly, and the high hat cymbal 3*b* is spaced from the stationary high hat cymbal 3*a*.

The tripod 2 comprises three legs 2*a*/2*b*/2*c*, a first center ring 2*d*, a second center ring 2*e* and three stays 2*f*/2*g*/2*h*. The center ring 2*d* is welded to the tube member 1*f* at an intermediate position spaced from the floor, and the other center ring 2*e* is also welded to the tube member at a lower position between the intermediate position and the floor. The legs 2*a*/2*b*/2*c* are connected at the upper ends to the first center ring 2*d* by means of pins 2*j*, and are turnable with respect to the first center ring 2*d*. The stays 2*f*/2*g*/2*h* are connected at the inner ends to the second center ring 2*e* by means of pins (not shown) and at the outer ends to the legs 2*a*/2*b*/2*c* by means of pins 2*k*. For this reason, the stays 2*f*/2*g*/2*h* are turnable with respect to the second center ring 2*e* as well as the associated legs 2*a*/2*b*/2*c*. The stay 2*f*/2*g*/2*h* sets a limit on the angular motion of the associated leg 2*a*/2*b*/2*c*.

When the player expands the legs 2*a*/2*b*/2*c* to the maximum angles, the legs 2*a*/2*b*/2*c* keep the mechanical actuator 1 upright on the floor, and the prior art high hat stand holds the high hat cymbals at an appropriate position for the player. In this situation, the legs 2*a*/2*b*/2*c* are angularly spaced from one another as shown in FIG. 2, and angle θ is 120 degrees. The foot pedal 1*c* occupies part of the sectrial area between the legs 2*b* and 2*c*. On the other hand, when the player folds the legs 2*a*/2*b*/2*c*, the tripod 2 minimizes the volume for custody.

The prior art high hat stand is encountered a problem in the playability of the high hat cymbals 3*a*/3*b*. This is because of the fact that the legs 2*b*/2*c* stand close to the foot pedal 1*c*. Even if the player places the foot pedal 1*c* in another sectrial area, two legs 2*a*/2*c* or 2*a*/2*b* stand close to the foot pedal 1*c*, and the player feels the legs 2*a*/2*b*, 2*b*/2*c* or 2*a*/2*c* an obstacle to the performance. Especially, when the high hat cymbals 3*a*/3*b* are played together with various drums, a lot of pedals are arranged around the player, and the player is liable to hit his foot on the leg.

Another prior art musical stand is disclosed in U.S. Pat. No. 5,105,706. The prior art musical stand is a dual leg structure. The foot pedal is provided under the telescoping sections corresponding to the guide 1*a* of the prior art high hat stand, and projects toward a player. Two supporting legs are fixed to the telescoping sections, and rearwardly projects onto the floor. The two supporting legs and the foot pedal keep the telescoping sections upright on the floor. While the player moves high foot between the pedal and the floor, any obstacle does not interfere with the foot motion, and the prior art musical stand disclosed in the U.S. Patent is free from the problem inherent in the prior art high hat stand shown in FIG. 1. However, some players feel the dual leg supporting structure unstable, and they can not concentrate themselves on the performance.

Thus, there is a trade-off between the playability and the sense of unease, and the drummers can not comfortably play the percussion musical instrument.

SUMMARY OF THE INVENTION

It is therefore an important object of the present invention to provide a stand for a musical instrument which allows a player comfortably play the musical instrument without sacrifice of the playability.

To accomplish the object, the present invention proposes to make a player easily add an additional leg to a biped supporter.

In accordance with one aspect of the present invention, there is provided a stand for a percussion instrument comprising a mechanical actuator including a rigid member upright to a stationary plane for holding the percussion instrument thereover and a foot pedal connected to the rigid member and linked with the percussion instrument for generating sound and a supporter including two legs connected to the rigid member, arranged in such a manner as to form a virtual triangle on the stationary plane together with the foot pedal and an additional leg detachable from the rigid member so as to make the supporter have a biped structure.

BRIEF DESCRIPTION OF THE DRAWINGS

The features and advantages of the stand for a musical instrument will be more clearly understood from the following description taken in conjunction with the accompanying drawings in which.

DESCRIPTION OF THE PREFERRED EMBODIMENT

Figure 3:
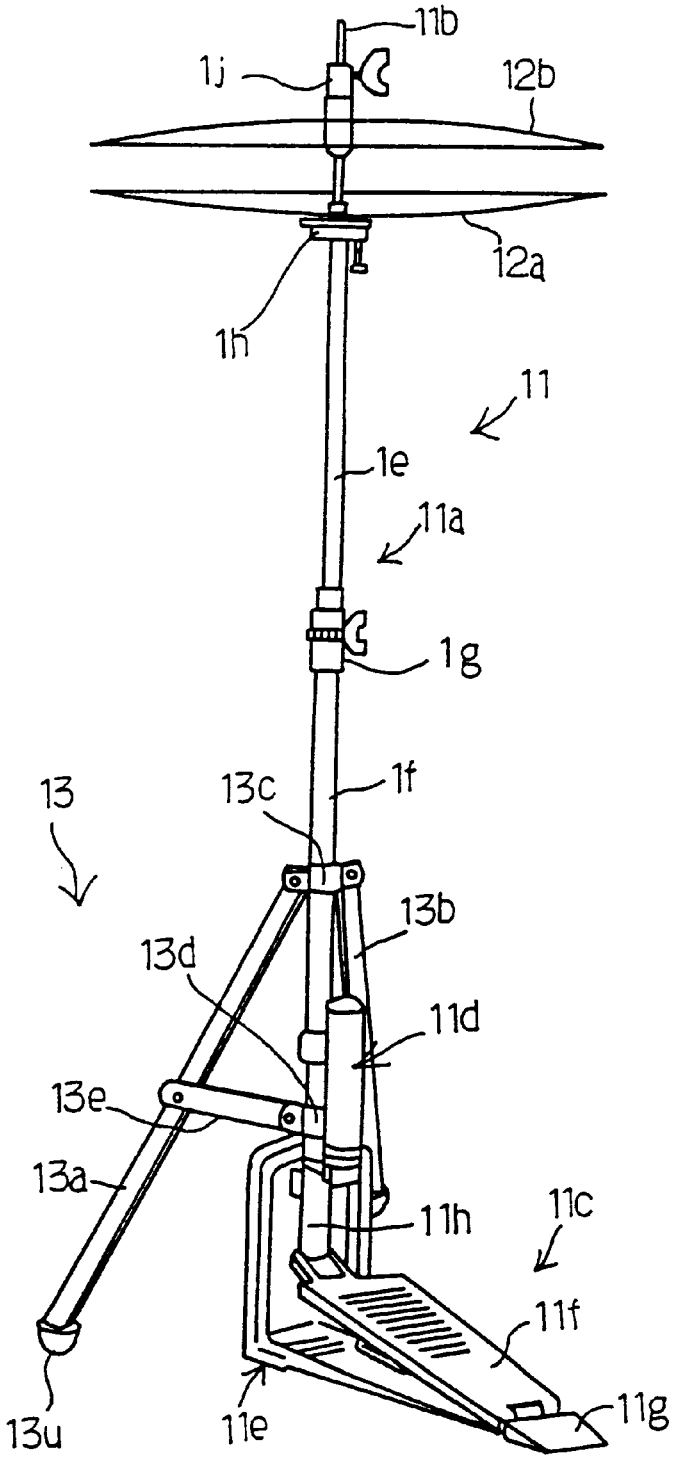
FIG. 3 is a perspective view showing a high hat stand according to the present invention.

Referring to FIG. 3 of the drawings, a high hat stand 10 embodying the present invention largely comprises a mechanical actuator 11 for high hat cymbals 12*a*/12*b* and a biped supporter 13. The mechanical actuator 11 also keeps one 12*a* of the high hat cymbals 12*a*/12*b* stationary and the other 12*b* movable, and a player makes the mechanical actuator clash the movable high hat cymbal 12*b* with the stationary high hat cymbal 12*a*.

The mechanical actuator 11 includes a guide 11*a*, a rod 11*b*, a foot pedal 11*c* and a spring unit 11*d*. The guide 11*a*, the rod 11*b* and the spring unit 11*d* are similar to those of the mechanical actuator 1, and component parts are labeled with the same references designating corresponding parts of the guide/the rod/ spring unit 1*a*/1*b*/1*d* without detailed description for the sake of simplicity. For this reason, description is hereinbelow focused on the foot pedal 11*c* and the biped supporter 13.

The foot pedal 11*c* includes an L-letter shaped pedal frame 11*e* put on the floor, a pedal plate 11*f* turnable with respect to a heel of the pedal frame 11*e* and a transmission belt 11*h* connected between the pedal plate 11*f* and the rod 11*b*. Although the foot pedal 11*c* is similar in structure to the foot pedal 1*c*, the manufacturer locates the foot pedal 11*c* at a particular position in relation to the biped supporter 13. The particular position will be described hereinlater in connection with the biped supporter 13.

The foot pedal 11*c* not only makes the rod 11*b* clash the movable high hat cymbal 12*b* with the stationary high hat cymbal 12*a* but also keeps the guide 11*a* upright on the floor to together with the biped supporter 13. When the player steps on the pedal plate 11*f*, the transmission belt 11*h* pulls down the rod 11*b* against the elastic force of the return spring, and the movable high hat cymbal 12*b* is clashed with the stationary high hat cymbal 12*a*. The high hat cymbals 12*a*/12*b* generate sound. The player may strike the high hat cymbal 12*b* with a stick. When the player releases the pedal plate 11*f*, the return spring urges the rod 11*b* to move upwardly, and the movable high hat cymbal 12*b* is spaced from the stationary high hat cymbal 12*a*.

Figure 5:
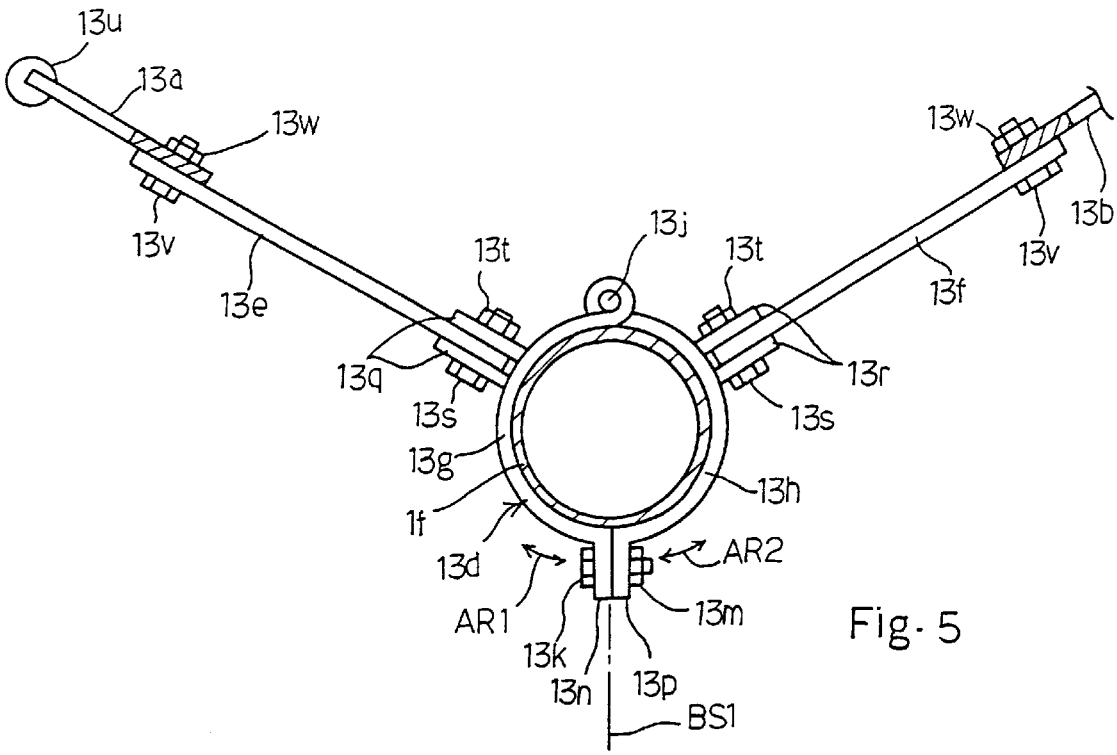
FIG. 5 is a cross sectional view taken along line A—A of FIG. 4 and showing a connection between a center ring and two legs.

The biped supporter 13 includes two leas 13*a*/13*b*, two center rings 13*c*/13*d* and two stays 13*e*/13*f* (see FIG. 5). Although the biped supporter 13 can not keep the guide 11*a* upright, the foot pedal cooperates with the biped supporter 13 so as to make the guide 11*a* keep the high hat cymbals 12*a*/12*b* at appropriate position over the floor. The component parts of the high hat stand according to the present invention are less than those of the prior art high hat stand, and the production cost is reduced.

Figure 4:
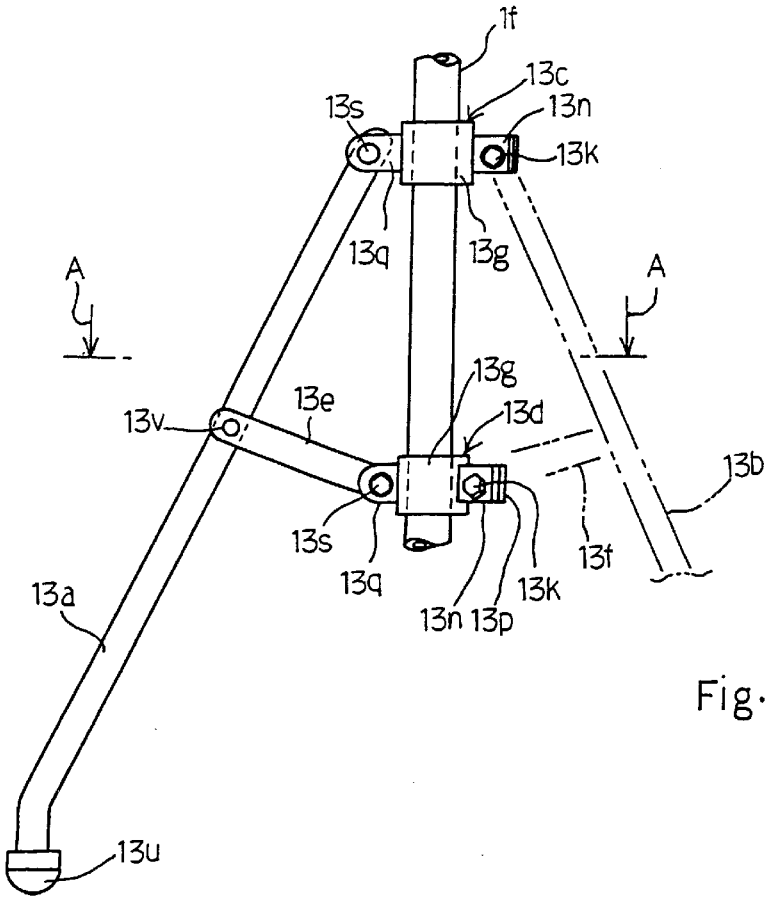
FIG. 4 is a front view showing a biped supporter incorporated in the high hat stand.

The structure of the biped supporter 13 is well understood from FIGS. 4 and 5. The center rings 13*c*/13*d* are similar to one another, and are attached to the tube member 1*f*. The center ring 13*c* is spaced from the other center ring 13*d*. The center rings 13*c*/13*d* has a pair of semi-cylindrical members 13*g*/13*h*. End portions of the semi-cylindrical members 13*g*/13*h* are curled, and the curled end portions are assembled with a pin 13*j*. The semi-cylindrical members 13*g*/13*h* are turnable around the pin 13*j*. For this reason, the center ring 13*c*/13*d* is opened and closed as indicated by arrows AR1. AR2. When the center ring 13*c*/13*d* is opened, the tube member 1*f* is inserted into the inner space of the center ring 13*c*/13*d*. The center ring 13*c*/13*d* is closed, and a bolt 13*k* is screwed into a nut 13*m* through holes formed in the other end portions 13*n*/13*p* of the semi-cylindrical members 13*g*/13*h*. Thus, the split center rings 13*c*/13*d* are easily attached to the tube member 1*f* at arbitrary positions without sliding along the tube member 1*f*. Moreover, the tripod 2 is easily replaced with the biped supporter 13, and user can remodel the prior art high hat stand to the high hat stand according to the present invention.

The center ring 13*c*/13*d* further has two pairs of projections 13*q*/13*r*. In this instance, the two pairs of projections 13*q*/13*r* are spaced from the other end portions 13*n*/13*p* by 120 degrees, and are further spaced from one another by 120 degrees. Thus, the other end portions 13*n*/13*p* and the two pairs of projections 13*q* and 13*r* are spaced along the circumference of the center ring 13*c*/13*d* at intervals of 120 degrees. The projections of each pair 13*q*/13*r* are spaced from each other so as to form a gap, and an upper end portion of the leg 13*e*/13*f* or an inner end portion of the stay 13*e*/13*f* is inserted into the gap. Though not shown in the drawings, through holes are formed in the projections 13*q*/13*r*, the upper portions of the legs 13*a*/13*b* and the inner end portions of the stays 13*e*/13*f*, respectively, and the upper end portions and the inner end portions are turnably connected to the pairs of projections 13*q*/13*r* by means of bolts 13*s* and nuts 13*t*.

Rubber pieces 13*u* are attached to the lower ends of the legs 13*a*/13*b*, and prevent the legs 13*a*/13*b* from slippage on the floor. Through-holes are formed in the intermediate portions of the legs 13*a*/13*b*, and the outer end portions of the stays 13*e*/13*f* are also formed with through-holes. The through-holes of the intermediate portions are aligned with the through-holes of the outer end portions, and the stays 13*e*/13*f* are turnably connected to the legs 13*a*/13*b* by means of bolts 13*v* and nuts 13*w*. Thus, the center rings 13*c*/13*d* are fixed to the tube member 1*f*, and the center rings 13*c*/13*d*, the legs 13*a*/13*b* and the stays 13*c*/13*d* are turnably assembled with one another.

Figure 6:
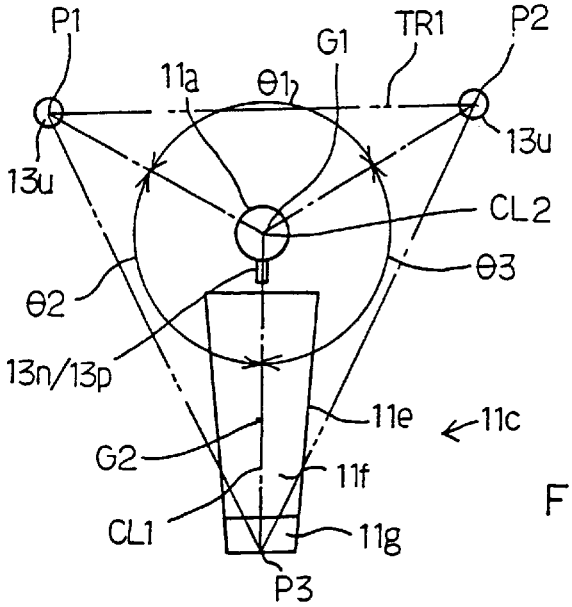
FIG. 6 is a plane view showing relative relation between the legs and a foot pedal.

When the player spreads the legs 13*a*/13*b*, the legs 13*a*/13*b* turn, and are spaced from the tube member 1*f*. In this situation, the rubber pieces 13*u* and the pedal frame 11*e* are located on the floor as shown in FIG. 6. Angles θ1, θ2 and θ3 between the rubber pieces 13*u* and the other end portions 13*n*/13*p* are 120 degrees, and the center line CL1 of the pedal frame 11*e* is aligned with the boundary surface between the other end portions 13*n* and 13*p*. Thus, the rubber pieces 13*u* are located at two vertexes P1/P2 of a virtual triangle TR1, and the other vertex P3 is on the center line CL1.

While a player is playing a tune, he sits on a chair placed on the opposite side to the line between the vertexes P1 and P2 with respect to the center line CL2 of the rod 11*b*. Even through the player moves his foot between the pedal plate 11*f* and another pedal, he does not hit the foot with the legs 13*a*/13*b*. Thus, the high hat stand according to the present invention never provides an obstacle against the motion of the player.

The stationary high hat cymbal 12*a* and the movable high hat cymbal 12*b* are implemented by circular metal plates, and are attached to the upper end of the guide 11*a* and the upper end of the rod 11*b*, respectively. The center of gravity G1 of the assemblage is on the center line CL2 of the rod 11*b*. The foot pedal 11*c* has the center of gravity G2 on the center line CL1. Both centers of gravity G1/G2 are on the same side of the line P1–P2 between the vertexes P1 and P2, and fall within the virtual triangle TR1. Although the moment around the line P1–P2 due to the center of gravity G1 and the moment around the line P1–P2 due to the center of gravity G2 are exerted on the high hat stand, the moments are received by the pedal frame 11*e*, and the pedal frame 11*e* has sufficient mechanical strength to receive the moments. For this reason, the high hat stand according to the present invention is stable on the floor, and hardly falls down. Even if the center of gravity G1 is moved beyond the line P—P, the foot pedal 11*c* keeps the high hat cymbals 12*a*/12*b* stable in so far as the moment due to the center of gravity G2 is much larger than the moment due to the center of gravity G1.

Figure 1:
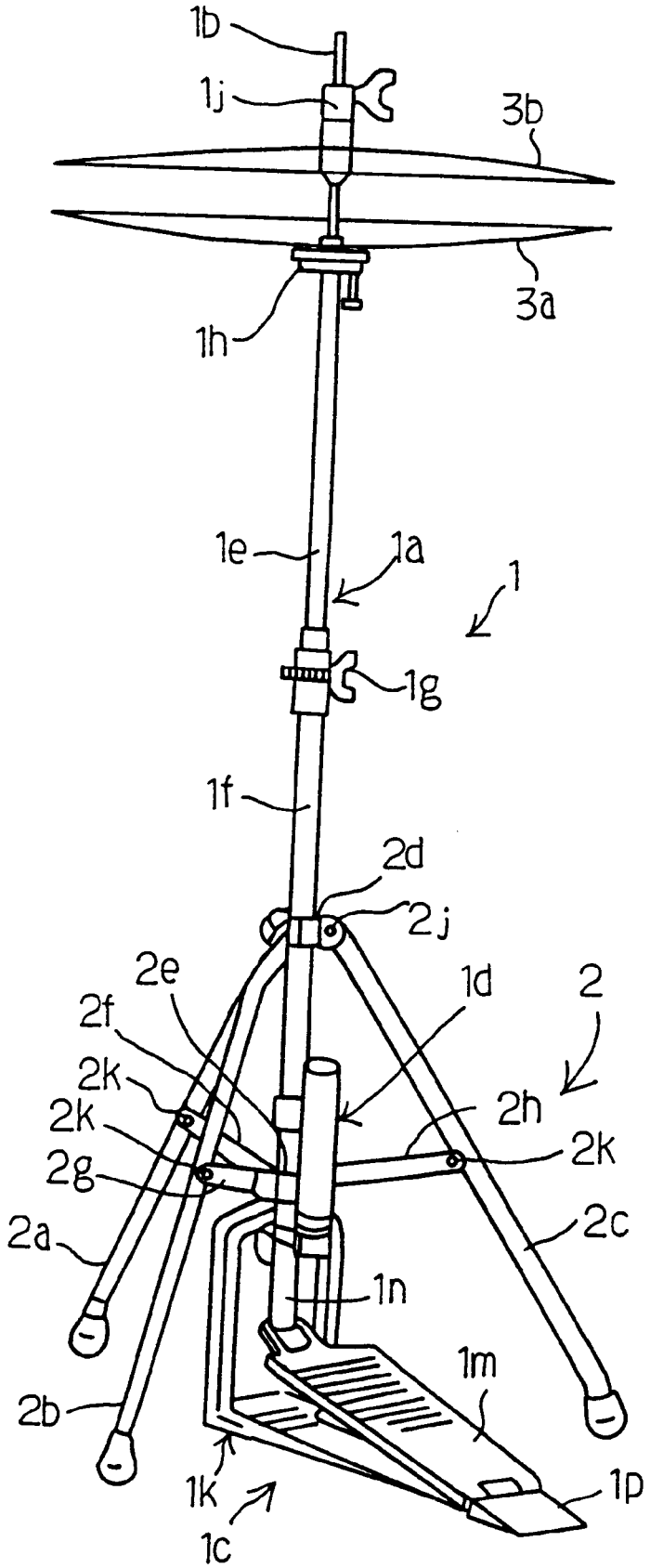
Fig. 1 PRIOR ART
FIG. 1 is a perspective view showing the prior art high hat stand.
Figure 2:
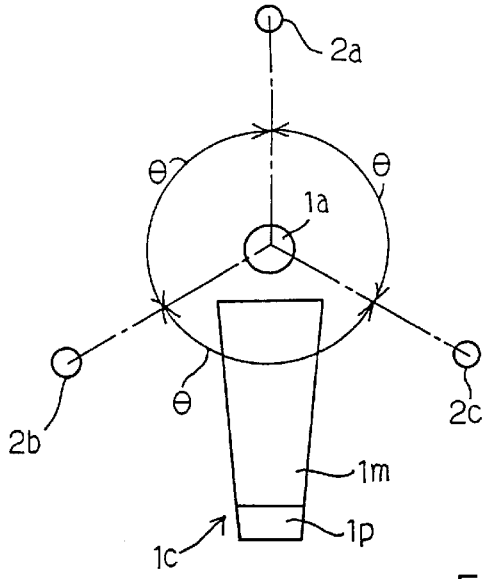
Fig. 2 PRIOR ART
FIG. 2 is a plane view showing the angular positions of the legs and the foot pedal.

If a player feels the biped supporter 13 unstable, the player loosens the bolts 13*k* and the nuts 13*m*, and inserts an additional leg BS between the other end portions 13*n* and 13*p* of the center ring, 13*c* and an additional stay between the other end portions 13*n* and 13*p* of the other center ring 13*d*. The player screws the bolts 13*k* into the nuts 13*m*, and turns the foot pedal 11*c* at 180 degrees. Then, the biped supporter 13 is changed to a tripod shown in FIG. 2.

As will be appreciated from the foregoing description, the two legs 13*a*/13*b* and the foot pedal 11*c* keep the percussion instrument stable over the floor. The legs 13*a*/13*b* of the stand according to the present invention is less than those of the prior art stand for a percussion instrument, and the production cost is reduced rather than that of the prior art stand.

The two legs 13*a*/13*b* are located on the opposite side to the foot pedal with respect to the center line CL2 of the rod 11*b*. Although the player moves his foot between the foot pedal 11*c* and another position, the player never hit his foot on the legs 13*a*/13*b*, and the stand for a percussion instrument according to the present invention offers comfortable environment to the player.

Moreover, when the center of gravity G1 falls within the virtual triangle, the stand for a percussion instrument keeps the percussion instrument stable over the floor.

Finally, the split center rings 13*c*/13*d* allows user to easily assemble the biped supporter 13 to the tube member 1*f*, and the user can remodel the biped supporter 13 to a tripod. In other words, a player can select a supporter between the biped structure and the tripod, and does not feel the stand unease.

Although a particular embodiment of the present invention has been shown and described, it will be apparent to those skilled in the art that various changes and modifications may be made without departing from the spirit and scope of the present invention. For example, the stand according to the present invention is available for any kind of percussion instrument in so far as the percussion instrument requires a pedal manipulated by a player during a performance.

What is claimed is:

1. A stand for a percussion instrument comprising a mechanical actuator including a rigid member upright to a stationary plane for holding said percussion instrument thereover and a foot pedal connected to said rigid member and linked with said percussion instrument for generating sound, and a supporter including two legs connected to said rigid member and arranged in such a manner as to form a virtual triangle on said stationary plane together with said foot pedal and an additional leg detachable from said rigid member so as to make said supporter have a biped structure.

2. The stand for a percussion instrument as set forth in claim 1, in which said two legs are held in contact with said stationary plane at respective contact points located on the opposite side to said foot pedal with respect to said rigid member.

3. The stand for a percussion instrument as set forth in claim 2, in which said contact points are respectively located at two vertexes of said virtual triangle, and the remaining vertex of said virtual triangle is on a first center line of said foot pedal extending in a longitudinal direction thereof.

4. The stand for a percussion instrument as set forth in claim 3, in which said percussion instrument and said rigid member has a center of gravity located on the same side as the foot pedal with respect to a line between said two vertexes.

5. The stand for a percussion instrument as set forth in claim 3, in which said rigid member has a second center line aligned with a center of said virtual triangle, and lines drawn from said center to the three vertexes are spaced from one another by 120 degrees.

6. The stand for a percussion instrument as set forth in claim 1, in which said supporter is foldable.

7. The stand for a percussion instrument as set forth in claim 6, in which said supporter further includes split center rings changed between split state and closed state, allowing said rigid member to pass through gaps created in said closed state and clamping said rigid member in said closed position at certain positions spaced from each other and two stays turnably connected at inner ends thereof to one of said split center rings closer to said stationary plane than the other split center ring and at outer ends thereof to intermediate positions of said two legs, and said two legs are turnably connected at upper ends thereof to said other split center ring.

8. The stand for a percussion instrument as set forth in claim 7, in which said supporter further includes nonskid members attached to lower end of said legs so as to prevent said legs from slippage on said stationary plane.

9. The stand for a percussion instrument as set forth in claim 7, in which said additional leg has one end portion turnably clamped by one of said center rings, and said supporter further had an additional stay turnably connected between said additional leg and the other of said center rings.

10. The stand for a percussion instrument as set forth in claim 1, in which said rigid member includes a guide having an inner space extending along a longitudinal direction thereof, a rod slidably inserted into said inner space and having an upper end portion projecting from an upper end of said guide and an lower end connected to said foot pedal, and said percussion instrument is connected to said guide and said rod so that said percussion instrument generates said sound due to a relative motion between said guide and said rod.

11. The stand for a percussion instrument as set forth in claim 10, in which said guide is split into a plurality of guide members projectable from and retractable into one of said plurality of guide members.

12. The stand for a percussion instrument as set forth in claim 11, in which said rigid member further includes a first coupling member for connecting a first cymbal to said rod and a second coupling member for connecting a second cymbal to another of said plurality of guide members.

13. The stand for a percussion instrument as set forth in claim 12, in which said first cymbal and said second cymbal form a pair of high hat cymbals clashed with one another.

14. The stand for a percussion instrument as set forth in claim 12, further comprising a return spring connected to said rod so as to urge said first cymbal to be spaced from said second cymbal.

15. A stand for a pair of cymbals clashed with one another comprising a mechanical actuator including a guide upright to a stationary plane and having a plurality of tube members expanded and contracted for regulating a height of said guide to a value, a rod member slidably inserted into an inner space of said plurality of tube members, a first coupling member connecting one of the cymbals of said pair to an upper end portion of said rod, and a second coupling member connecting the other of said cymbals to an upper end of one of said plurality of tube members from which said upper end portion of said rod projects;

a foot pedal including a pedal frame placed on said stationary plane and connected to a lower end portion of said guide, and a pedal plate turnably supported by said pedal frame and connected to said rod;

a return spring connected between said guide and said rod, and urging said rod so as to space said cymbals from each other; and a supporter includes split center rings changed between split state and closed state, allowing said guide to pass through gaps created in said closed state and clamping said guide in said closed position at certain positions spaced from each other, two stays turnably connected at inner ends thereof to one of said split center rings closer to said stationary plane than the other split center ring, two legs turnably connected at upper end thereof to said other split center ring and at intermediate positions to outer ends of said two stays and having respective lower ends held in contact with said stationary plane in such a manner that said pedal frame and said lower ends form a virtual rectangular on said stationary plane, an additional leg clamped by said other split center ring in such a manner as to be detachable therefrom, and an additional stay having one end clamped by said one of said split center rings and the other end turnably connected to said additional leg so as to be detachable together with said additional leg, said lower ends being located on the opposite side to said pedal frame with respect to said guide.

* * * * *